US005134336A

United States Patent [19]

Chakrabarti et al.

[11] Patent Number: 5,134,336

[45] Date of Patent: Jul. 28, 1992

[54] FLUORESCENT LAMP HAVING DOUBLE-BORE INNER CAPILLARY TUBE

[75] Inventors: Kirti B. Chakrabarti, Lynnfield; Robert E. Levin, Hamilton, both of Mass.

[73] Assignee: GTE Products Corporation, Danvers, Mass.

[21] Appl. No.: 698,883

[22] Filed: May 13, 1991

[51] Int. Cl.[5] ..... H01J 61/42; H01J 61/34; H01J 61/35

[52] U.S. Cl. ..... 313/25; 313/488; 313/493; 313/573; 313/609; 313/610; 313/634; 313/635; 313/642

[58] Field of Search ..... 313/487, 25, 493, 634, 313/635, 488, 573, 642, 639, 609, 610, 611, 612

[56] References Cited

U.S. PATENT DOCUMENTS

| | | | |
|---|---|---|---|
| 2,123,709 | 7/1938 | Bristow et al. | 313/610 |
| 2,152,999 | 4/1939 | Milner | 176/122 |
| 2,976,451 | 3/1961 | Reiling et al. | 313/171 |
| 3,651,366 | 3/1972 | Gianni | 313/573 |
| 3,778,662 | 12/1973 | Johnson | 313/109 |
| 3,947,719 | 3/1976 | Ott | 313/489 |
| 4,039,889 | 8/1977 | Vicai | 313/573 X |
| 4,196,374 | 4/1980 | Witting | 315/58 |
| 4,441,045 | 4/1984 | Sprengers | 313/638 X |
| 4,622,485 | 11/1985 | Miyashita et al. | 313/572 X |
| 4,710,679 | 12/1987 | Budinger et al. | 315/58 |
| 4,727,283 | 2/1988 | van Kemenade et al. | 313/487 X |
| 4,847,530 | 7/1989 | English et al. | 313/25 |
| 4,864,180 | 9/1989 | English et al. | 313/44 |
| 4,945,288 | 7/1990 | Morris et al. | 313/25 |

FOREIGN PATENT DOCUMENTS

| | | | |
|---|---|---|---|
| 0187855 | 11/1982 | Japan | 313/493 |
| 0037646 | 2/1985 | Japan | 313/572 |

*Primary Examiner*—Donald J. Yusko
*Assistant Examiner*—Ashok Patel
*Attorney, Agent, or Firm*—Carlo S. Bessone

[57] ABSTRACT

A miniature, low-wattage fluorescent lamp includes a double-bore inner capillary tube having a pair of ends and a convoluted shape. The inner capillary tube is comprised of a vitreous material (e.g., quartz) which is capable of transmitting ultraviolet radiation. A pair of electrodes (e.g., mercury pool) is located at one end of the inner capillary tube and disposed within respective bores. An ionizable medium is enclosed within the inner capillary tube and includes an inert starting gas and a quantity of mercury. When energized, the ionizable medium generates an arc discharge between the electrodes consisting of ultraviolet radiation. A phosphor coating responsive to the ultraviolet radiation is disposed on an outer surface of the inner capillary tube and remote from the arc discharge. An outer jacket of vitreous material surrounds the inner capillary tube and contains an inert gas at a predetermined pressure.

15 Claims, 3 Drawing Sheets

FLUORESCENT LAMP HAVING DOUBLE-BORE INNER CAPILLARY TUBE

GOVERNMENT INTEREST IN INVENTION

The Government has rights in this invention pursuant to Contract No. DTCG23-87-C-20026 awarded by the United States Coast Guard.

CROSS-REFERENCE TO A RELATED APPLICATION

This application discloses, but does not claim, inventions which are claimed in U.S. Ser. No. 07/698,882 filed concurrently herewith and assigned to the Assignee of this application.

FIELD OF THE INVENTION

This invention relates in general to arc discharge lamps and pertains, more particularly, to a miniature, low-wattage fluorescent lamp suitable for use in navigational signal lighting, such as a lighted buoy. Lighted buoys employ flashing lights and are used to mark navigable channels and wrecks, shallows, or other hazards The reliability of lamps used in navigational signal lighting is an important factor because servicing is often carried out on an annual basis.

BACKGROUND OF THE INVENTION

Tungsten filament lamps have been heavily relied on in the past for navigational signal lighting. Besides having low efficiencies, the filament in such lamps is very brittle and therefore susceptible to shock and vibration. This results in premature lamp failure. Also, in general, they have short life of about 500 hours.

Modern light sources, more particularly arc discharge sources, have been or are being developed for navigational signal lighting applications because of the many advantages offered by these light sources. It is well known that an arc discharge source generally provides better efficacy and longer life than its tungsten filament lamp counterpart. Since the electrodes are heavier than the filament, the lamp may be more rugged and less susceptible to shock and vibration.

In an arc discharge lamp, the length and width of the arc are design variables to a large extent. In a tungsten filament lamp, the length and width of the filament are for the most part determined by the lamp wattage. Thus, there is greater flexibility in the choice of optical characteristics of the light source with arc discharge lamps than with comparable tungsten filament lamps.

The principal object of a navigational signal light is to emit as much light flux as possible from a reliable light source and direct the light into the plane of the horizon. The light may be collected into one or more narrow beams which are mechanically rotated, or it may be radiated in all horizontal directions simultaneously. There are basically two types of rotating beams or beacons. In the first type, a reflector or other means of concentrating the light is used with the lamp. The entire optical system is rotated. This method generally produces a single beam; all of the emitted light is swept through 360 degrees. For an example of this first type of beacon and an arc discharge lamp for use therewith, see U.S. Pat. No. 4,847,530 which issued to English et al and which is assigned to the same Assignee as the present application. This patent describes an arc discharge lamp which, in one specific example, is rated at 175 watts.

In the second type, a rotating screen surrounds a stationary lamp. The screen contains multiple lenses or other means for concentrating light. The rotating screen generally produces multiple rotating beams, one beam associated with each lens or sector subtended by a lens. The emitted light within any sector is formed into a pencil beam and swept only within that sector. It is this type of beacon and, more particularly, the light source associated therewith, which is the subject of this disclosure.

For an example of this second type of beacon and an arc discharge lamp for use therewith, see U.S. Pat. No. 4,864,180 which issued to English et al and which is assigned to the same Assignee as the present application. This patent describes a metal-halide arc discharge lamp which; in one specific example, is rated at 45 watts.

Although the arc discharge lamps in the above-described patents are quite suitable for various navigational lighting applications, they would tend to generate too much heat if enclosed within the relatively small beacon enclosure of a typical lighted buoy.

It would be an advancement of the art if a miniature, low-wattage arc discharge lamp could be provided which is suitable for use in a navigational signal light, such as a lighted buoy.

Fluorescent lamps are well known in the art and are used for a variety of lighting applications. Standard fluorescent lamps are characterized as low-pressure arc discharge lamps and may include an envelope whose internal surface is coated with phosphor. An electrode structure is located at each end of the envelope. The envelope contains a quantity of an ionizable medium, such as mercury and a fill gas at a low pressure, for example, in the order of 1 to 5 torr.

When a voltage is applied across the electrodes, electrons will be emitted, ionizing the gas inside the envelope. The resultant ionization and recombination of ions and electrons produce primarily short wavelength ultraviolet radiation of 253.7 nanometers which is converted by means of the phosphor into radiation of a longer wavelength and a spectral distribution (depending on the phosphor material used) in the near ultraviolet or in the visible part of the spectrum.

One of the most important aspects of discharge lamp design is to ensure that as much of the input power as possible is directed into transitions producing the desired wavelengths (e.g., 253.7 nanometers). The problems in doing this efficiently multipy as the size of the source decreases.

SUMMARY OF THE INVENTION

It is, therefore, an object of the present invention to obviate the disadvantages of the prior art.

It is still another object of the invention to provide a light source suitable for use in a navigational signal light, such as a lighted buoy.

It is another object of the invention to provide a light source having a relatively high efficiency.

It is still another object of the invention to provide a light source having a relatively long life.

These objects are accomplished in one aspect of the invention by the provision of a fluorescent lamp comprising a double-bore inner capillary tube having a pair of ends and a convoluted shape. The inner capillary tube is capable of transmitting ultraviolet radiation. A pair of electrodes (which may be mercury pool electrodes or tungsten rods) are located at one end of the inner capillary tube and disposed within respective bores. An ionizable medium is enclosed within the inner capillary tube and includes an inert starting gas and a quantity of mercury at a predetermined pressure. The ionizable medium is capable of generating between the electrodes an arc discharge comprising ultraviolet radiation. A phosphor coating responsive to the ultraviolet radiation is disposed on an outer surface of the inner capillary tube. The phosphor coating is located remote from the arc discharge. An outer jacket of vitreous material surrounds the inner capillary tube. Finally, a base may be secured to one end of the outer jacket of the lamp.

In accordance with further aspects of the present invention, the inner capillary tube includes a single U-shaped portion and a pair of legs. The legs are in a contiguous relationship or separated a distance not more than 0.010 inch. In another embodiment, the inner capillary tube includes a pair of U-shaped portions with each of the U-shaped portions having a pair of legs associated therewith. The legs of each pair of legs are in a contiguous relationship or closely adjacent with each other.

In accordance with further teachings of the present invention, the wattage of the lamp is from 0.5 watt to about 6 watts. In a preferred embodiment, the the inner capillary tube has an outer diameter of approximately 4 millimeters and the outer jacket has an outer diameter of approximately 12.7 millimeters (0.5 inch). In a preferred embodiment, the inner capillary tube contains argon at a pressure of approximately 40 torr.

In accordance with still further aspects of the present invention, the pressure of the ionizable medium within the capillary tube is within the range of from 25 to 40 torr. Preferably, the outer jacket contains an inert gas such as nitrogen at a pressure of about 300 torr.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
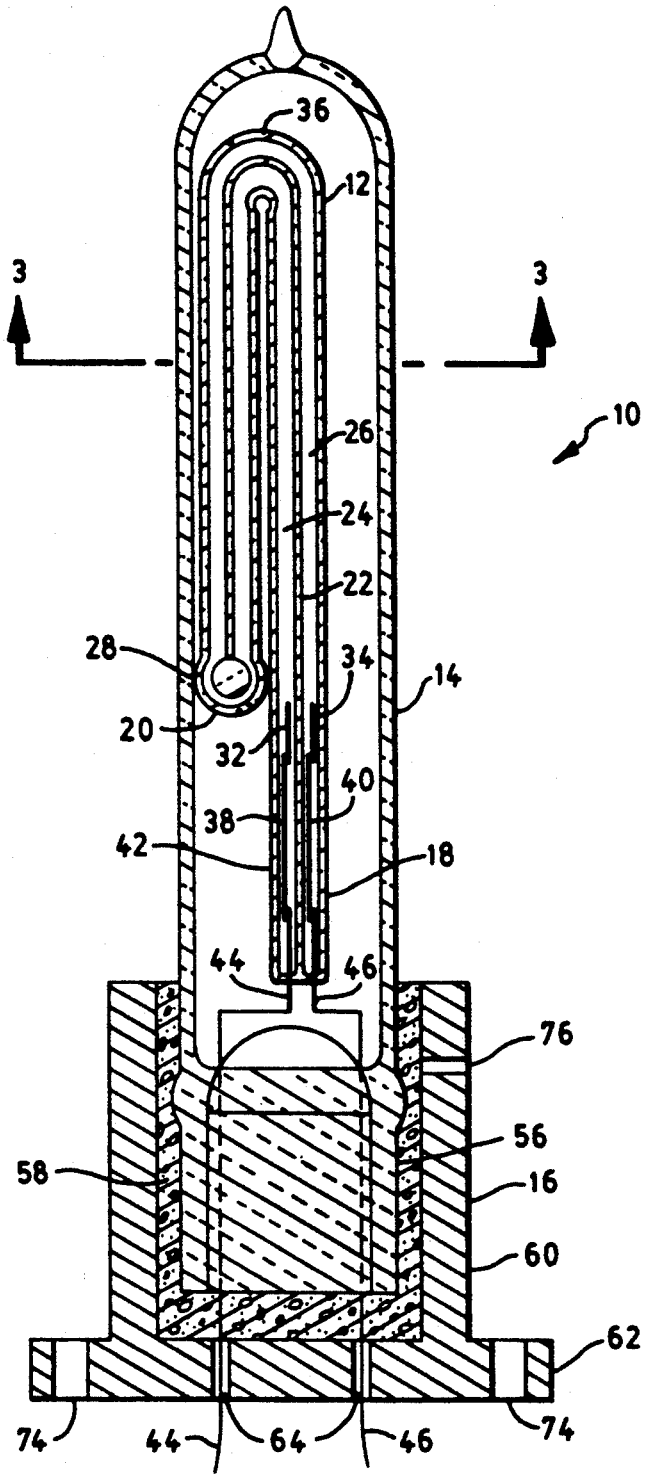
FIG. 1 represents a cross-sectional side elevation view a fluorescent lamp in accordance with one embodiment of the present invention.
Figure 2:
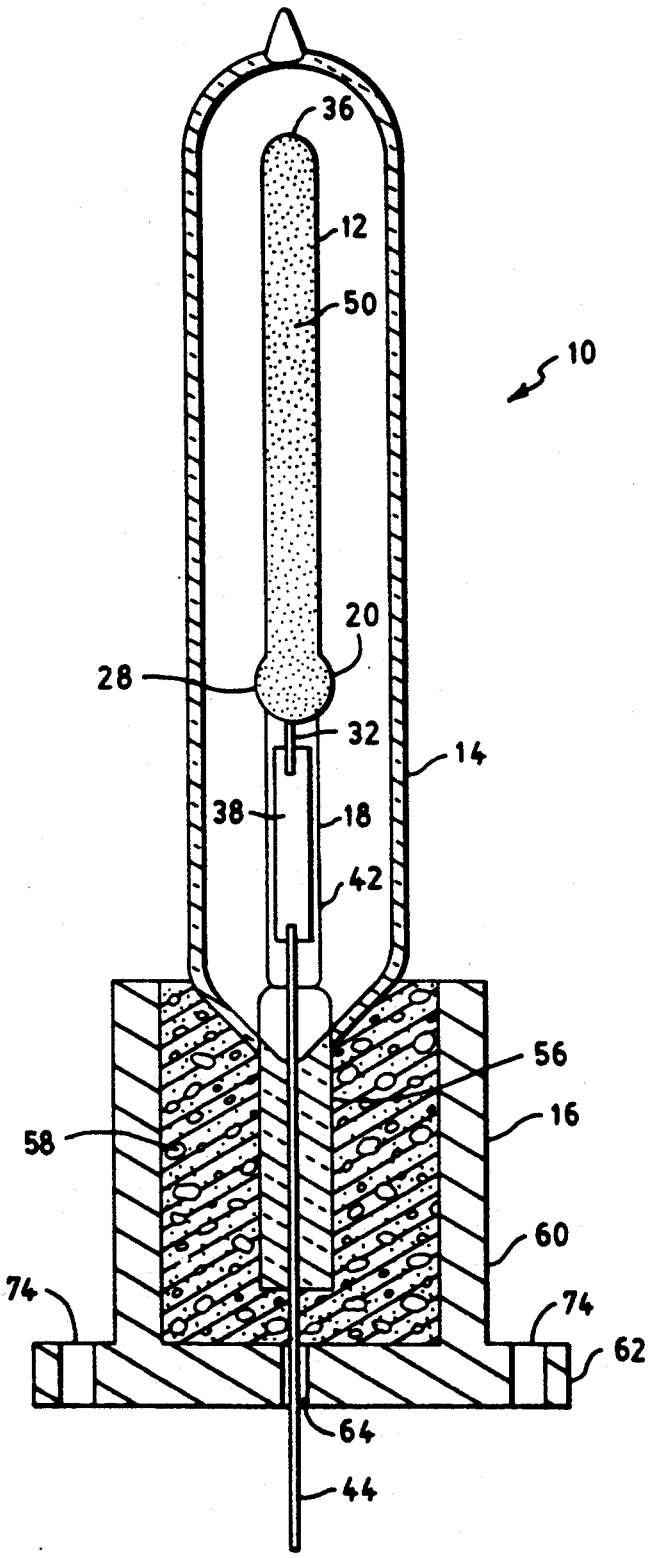
FIG. 2 is a partial cross-sectional side elevation view of the fluorescent lamp in FIG. rotated 90 degrees.

Referring to the drawings and to FIGS. 1 and 2 in particular, shown therein and generally designated by the reference character 10 is a fluorescent lamp constructed in accordance with one embodiment of the invention. As shown therein, fluorescent lamp 10 includes a generally convoluted inner capillary tube 12 sealed within an outer jacket 14. If desired, a base 16 may be secured to one end of the outer jacket of the lamp. The lamp is preferably miniature in size having, for example, an outer jacket diameter of 0.5 inch (12.7 millimeters) and a maximum length of 3.0 inches (7.62 centimeters). The lamp wattage is typically within the range of from 0.5 watt to about 6.0 watts.

In the embodiment of the invention as best shown in FIG. 1, inner capillary tube 12 is formed with a single U-shaped portion 36. Preferably, the legs of the U-shaped tube 12 are either in a contiguous relationship with each other or closely adjacent with a separation distance of less than 0.010 inch.

Figure 3:
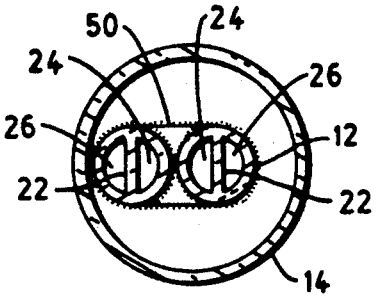
FIG. 3 is a cross-sectional view of the fluorescent lamp in FIG. 1 taken along the line 3—3.

Inner capillary tube 12 includes an internal separator 22 which divides the internal cavity of the tube into a pair of bores 24, 26. As best shown in FIG. 1, separator 22 extends from end 18 of capillary tube 12 to an opposite end 20. An area 28 at opposite end 20 provides an arc joining region. As depicted in FIG. 3, each bore 24, 26 may have a semi-circular cross-section.

Inner capillary tube 12 may consist of a glass or quartz material substantially transparent to ultraviolet radiation, such as 253.7 nanometers.

A pair of electrodes 32 and 34 is disposed within end 18 of inner capillary tube 12. As illustrated in FIG. 1, electrode 32 protrudes within bore 24 and electrode 34 protrudes within bore 26. In a preferred embodiment, electrodes 32 and 34 are constructed from tungsten rods and form mercury pool electrodes. When the voltage induced arc is formed, a small fraction of the liquid mercury near the high current density spot of arc termination is vaporized. This also insures operation at temperatures below those normally associated with fluorescent lamp operation.

Metal foils 38, 40 formed of, for example, molybdenum are buried apart from each other within a common vacuum seal 42. Metal foils 38, 40 are respectively connected to outer lead wires 44, 46 extending to the outside.

An ionizable medium is enclosed within inner capillary tube 12 and includes an inert starting gas (e.g., argon) and 2 to 5 milligrams of mercury. The inert gas assists in starting since the vapor pressure of mercury is very low (e.g., 0.01 torr). The fill pressure should be within a range from about 25 to 40 torr in order to provide easy starting, long life and efficient lumen maintenance. When energized, the ionizable medium generates an arc discharge comprising ultraviolet radiation (e.g., 253.7 nanometers) and a limited proportion of visible radiation.

The convoluted double-bore construction of the inner capillary tube allows an elongated arc length to be contained within a compact space. For example, in the embodiment depicted in FIGS. 1 and 2, if the distance between the tip of one of the electrodes to the top of the U-shaped portion 36 is 1.5 inches (3.81 centimeters), the arc length will be approximately 6.0 inches (15.24 centimeters).

A suitable phosphor 50 responsive to the ultraviolet radiation generated within capillary tube 12 is disposed on the outer surface of inner capillary tube 12. Suitable phosphors may comprise, for example, a green-emitting phosphor having the general formula $Zn_2SiO_4$:Mn or a daylight phosphor consisting of a blend of $Ca_5F(PO_4)_3$:Sb and $Ca_5(F,Cl)(PO_4)_3$:Sb:Mn phosphors. Phosphor 50 is located remote from the arc discharge and the mercury which is contained within inner capillary tube 12. Locating the phosphor on the outer surface of the capillary tube prevents degradation of the phosphor due to exposure to the mercury arc.

Outer jacket 14 is constructed of vitreous material having a low coefficient of absorption in the visible spectrum. One suitable type of glass is borosilicate with lead available from Corning Glass Works as type 7720 under the tradename Nonex. Outer jacket 14 surrounds inner capillary tube 12 and is sealed by means of a pinch seal 56 to prevent atmospheric contamination of phosphor 50.

The volume between outer jacket 14 and inner capillary tube 12 may be filled with an appropriate inert gas, such as nitrogen at an appropriate pressure, say 300 torr. The fill pressure within the outer jacket affects the thermal characteristics of inner capillary tube 12 which during operation is cooled in part by conductive and convective flow within the outer jacket. This helps to maintain the required low mercury vapor pressure.

Base 16 includes a cylindrical portion 60 surrounding pinch seal 56 and a disk-shaped portion 62. Disk-shaped portion 62 includes a pair of apertures 64 through which lead wires 44 and 46 pass. A plurality of mounting holes 74 adapted to receive mounting screws (not shown) are formed around the periphery of disk-shaped portion 62. Base 16 is secured to the lower end of outer jacket 14 by means of an insulating cement 58 which is injected during manufacturing through at least one aperture 76 (FIG. 1) formed in cylindrical portion 60.

Figure 4:
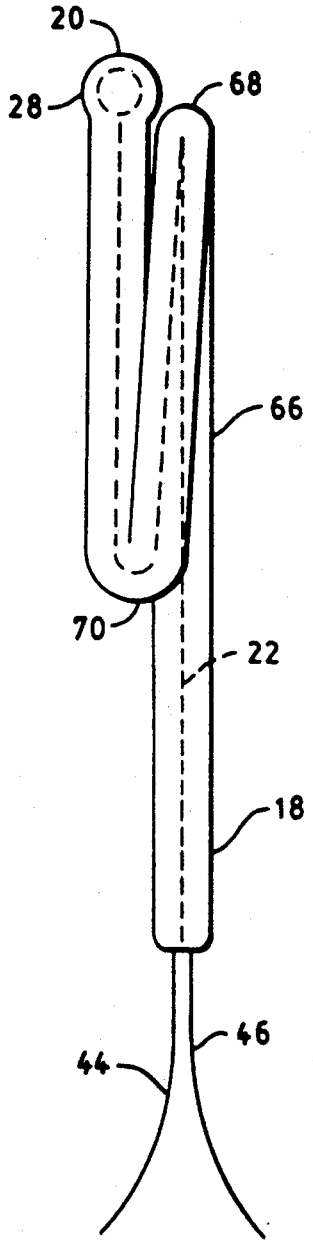
FIG. 4 is side elevation view of another embodiment of an inner capillary tube.
Figure 5:
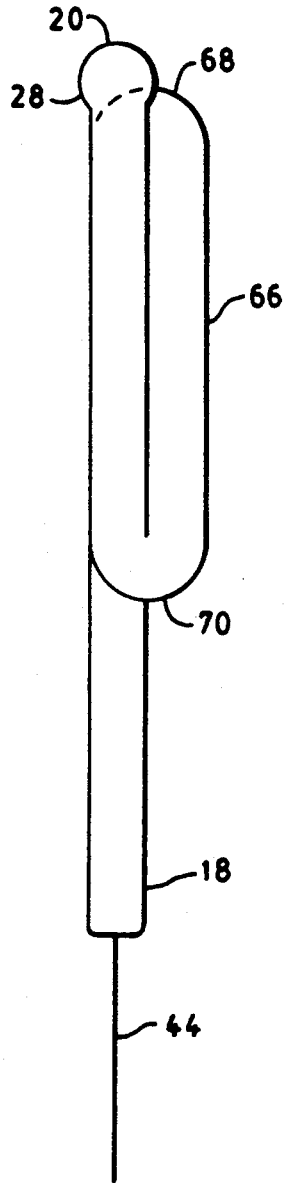
FIG. 5 is a side elevation view of the inner capillary tube in FIG. 4 rotated 90 degrees.

It is well within the scope of the invention to construct the inner capillary tube with a convoluted shape other than that shown in FIGS. 1 and 2. In this regard, FIGS. 4 and 5 illustrate an alternative embodiment for the inner capillary tube. An inner capillary tube 66 is shown prior to phosphor coating and prior to sealing of the outer jacket. As shown therein, a double-bore capillary tube 66 contains a first U-shaped portion 68 and a second U-shaped portion 70. Preferably, the legs associated with each portion 68 and 70 are either in a contiguous relationship or closely adjacent with each other. If separated, the distance between the legs is preferably less than 0.010 inch.

In the embodiment depicted in FIGS. 4 and 5, if the vertical distance between the tip of one of the electrodes (not shown) and the opposite end 20 of tube 66 is 1.5 inches (3.81 centimeters), the arc length will be approximately 9.0 inches (22.86 centimeters).

In a typical but non-limitative example of a miniature fluorescent lamp in accordance with the teachings of the present invention, the inner capillary tube is made from double-bore quartz glass having an outer diameter of about 4 millimeters and an inner diameter of about 2 millimeters. The inner capillary tube has a triple pass configuration similar to that depicted in FIGS. 4 and 5 and contains argon gas at a pressure of about 40 torr together with approximately 2 to 5 milligrams of mercury. The outer surface of the inner capillary tube is coated with $Zn_2SiO_4$:Mn phosphor which produces a primarily green spectrum. The vertical distance measured from the tip of one of the electrodes to the remote end 20 of the inner capillary tube is approximately 1.5 inches (3.81 centimeters). As a result of this convoluted double-bore construction, the arc length is approximately 9.0 inches (22.86 centimeters).

A pair of mercury pool electrodes (mercury pool or tungsten rods) are located at one end of the inner tube. Each electrode consists of a 0.008 inch diameter tungsten rod welded to one end of a rectangular strip or molybdenum foil having a width of 0.030 inch, a length of 0.5 inch (12.7 millimeters) and a thickness of 0.0008 inch. A lead-in wire of molybdenum having a diameter of 0.020 inch is welded to the other end of each molybdenum strip. An outer jacket of glass consisting of borosilicate with lead (type 7720 Nonex) having an outer diameter of approximately 0.5 inch (12.7 millimeters) and a length of approximately 3.0 inches (7.62 centimeters) surrounds the inner capillary tube and contains nitrogen gas at a pressure of about 300 torr.

The above lamp was successfully operated in a light beacon with a pulsed power supply which has an open circuit voltage of 1800 volts and which produces pulses having a width of 1000 microseconds and a period of 2.0 milliseconds. The lamp operated at 244 volts, 26 milliamps, and 3.2 watts to produce an intensity of 34.4 candelas. Due to the electrode construction and the relatively high pressure, the life of the lamp is expected to exceed 4000 hours.

At present, a typical lighted buoy may employ a 3 watt, 12 volt incandescent lamp rated at 500 hours and having an S-8 or S-11 clear bulb with a C-8 vertically-oriented incandescent filament. With a green filter, the 3 watt incandescent lamp produces 11 candelas.

The lamp of the present invention is ideally suited for use with the optics of a navigational signal such as a lighted buoy. The short arc tube length (i.e., vertical height) of the present invention provides efficient coupling with a relatively small effective field stop such as in the conventional Fresnel drum lens optics of navigational buoys. For the same power, the arc discharge source has higher luminous efficacy than its filamented counterpart; conversely, for an equivalent observable range, the arc source requires less power. Because of the lower power requirement, the lamp may readily be energized from a solar source thereby reducing the cost of maintaining the buoy. As previously mentioned, the arc source of the lamp is more rugged and has longer life than its filamented counterpart. These latter features also contribute to reduced maintenance costs for the buoy.

There has thus been shown and described a miniature, low-wattage fluorescent lamp suitable for use in a navigational signal light, such as a lighted buoy. The lamp has a relatively high efficiency and long life.

While there have been shown and described what are at present considered to be the preferred embodiments of the invention, it will be apparent to those skilled in the art that various changes and modifications can be made herein without departing from the scope of the invention. Therefore, the aim in the appended claims is to cover all such changes and modifications as fall within the true spirit and scope of the invention. The actual scope of the invention is intended to be defined in the following claims when viewed in their proper perspective based on the prior art.

What is claimed is:

1. A fluorescent lamp comprising:

a double-bore inner capillary tube having a pair of ends and a convoluted shape, said inner capillary tube including a pair of U-shaped portions, each of said U-shaped portions having a pair of legs associated therewith, the legs of each pair being in a contiguous relationship or closely adjacent to each other, said capillary tube being capable of transmitting ultraviolet radiation;

a pair of electrodes located at one end of said inner capillary tube and disposed within respective bores;

an ionizable medium enclosed within said inner capillary tube and including an inert starting gas and a quantity of mercury at a predetermined pressure, said ionizable medium being capable of generating between said electrodes an arc discharge comprising ultraviolet radiation;

a phosphor means responsive to said ultraviolet radiation disposed on an outer surface of said inner capillary tube, said phosphor means being remote from said arc discharge; and an outer jacket of vitreous material surrounding said inner capillary tube.

2. The fluorescent lamp of claim 1 wherein said inner capillary tube includes a single U-shaped portion and a pair of legs, said legs being in a contiguous relationship or closely adjacent.

3. The fluorescent lamp of claim 2 wherein said legs are separated a distance not greater than 0.010 inch.

4. The fluorescent lamp of claim 1 each leg of said pair is separated a distance not greater than 0.010 inch.

5. The fluorescent lamp of claim 4 wherein said pressure of said ionizable medium is within the range of from about 25 to 40 torr.

6. The fluorescent lamp of claim 1 wherein said inert gas within said inner capillary tube is argon.

7. The fluorescent lamp of claim 6 wherein said argon is at a pressure of about 40 torr.

8. The fluorescent lamp of claim 1 wherein the wattage of said lamp is from 0.5 watt to about 6.0 watts.

9. The fluorescent lamp of claim 1 wherein said inner capillary tube has an outer diameter of approximately 4 millimeters.

10. The fluorescent lamp of claim 1 wherein said outer jacket has an outer diameter of approximately 12.7 millimeters.

11. The fluorescent lamp of claim 1 wherein said electrodes within said inner capillary tube are mercury pool electrodes.

12. The fluorescent lamp of claim 1 wherein said outer jacket contains an inert gas at a predetermined pressure.

13. The fluorescent lamp of claim 12 wherein said inert gas within said outer jacket is nitrogen.

14. The fluorescent lamp of claim 13 wherein said nitrogen is at a pressure of about 300 torr.

15. The fluorescent lamp of claim 1 further including a base secured to one end of said outer jacket of said lamp.

* * * * *